United States Patent [19]

Wilson et al.

[11] 3,952,421

[45] Apr. 27, 1976

[54] DIELECTRIC HEATING ARRANGEMENT FOR DRYING A CONTINUOUSLY MOVING WEB OF MATERIAL

[75] Inventors: Thomas L. Wilson, Louisville; Charles M. Loring, Jr.; Peter H. Smith, both of Anchorage, all of Ky.

[73] Assignee: Chemetron Corporation, Chicago, Ill.

[22] Filed: Oct. 18, 1974

[21] Appl. No.: 515,923

[52] U.S. Cl. ..... 34/1; 219/10.61

[51] Int. Cl.[2] ..... F26B 3/34

[58] Field of Search ..... 34/1; 219/10.61

[56] References Cited

UNITED STATES PATENTS 2,779,848 1/1957 Bosomworth et al. ..... 34/1

3,426,439 2/1969 Ryman et al. ..... 34/1

*Primary Examiner*—John J. Camby

*Attorney, Agent, or Firm*—N. M. Esser

[57] ABSTRACT

A dielectric heating arrangement for drying wide wet webs of material is provided in which a rotatable drum structure is provided for supporting the web on its periphery and moving it past a stationary set of dielectric heating electrodes of the stray field type positioned close to the periphery of said drum over a substantial portion of the circumference thereof. The drum periphery comprises a series of closely spaced members which extend parallel to the axis of the drum, the outer edges of said members acting as the outer periphery of said drum on which the web is supported as it is moved past said electrodes.

28 Claims, 16 Drawing Figures

270
20
110
110
112
40b
24
110
198
28
200
40a
40c
110
22
110
30
42
44
106
108
102
36
46
34
34
38
116
114
104
36
26
26

FIG. 13
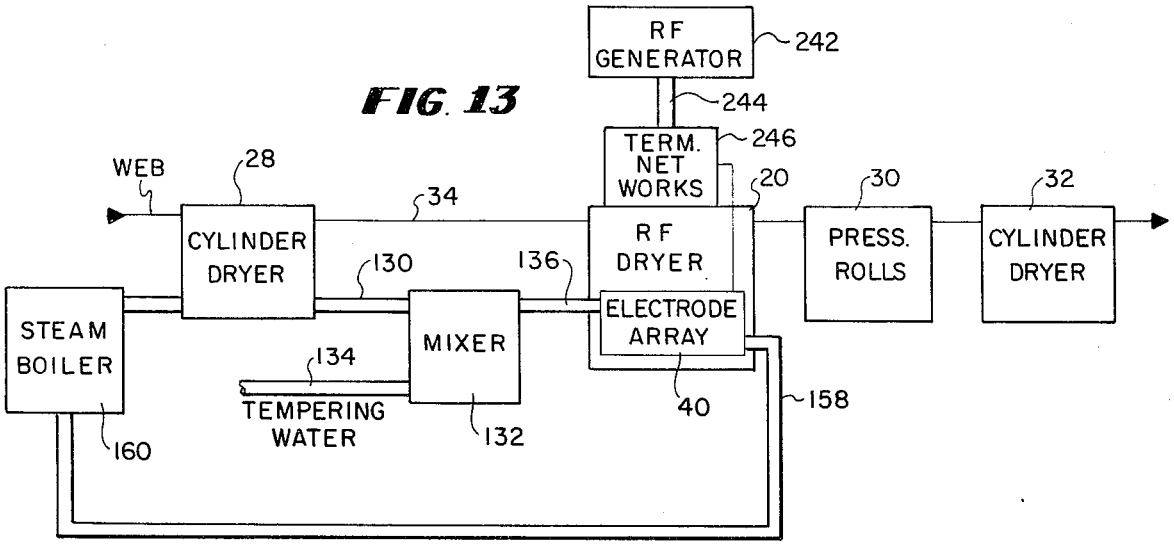
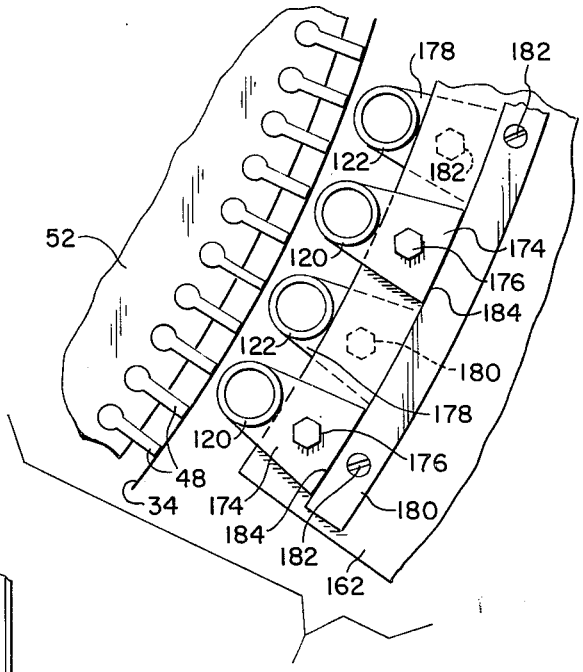
FIG. 12
FIG. 14
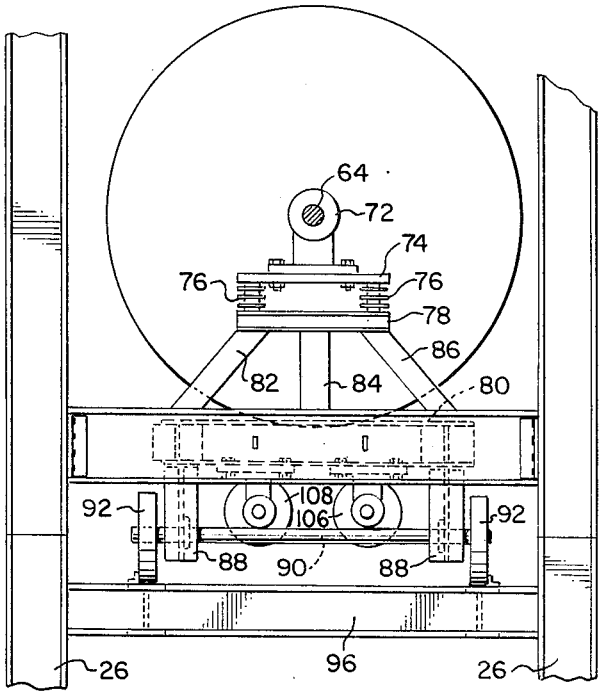

DIELECTRIC HEATING ARRANGEMENT FOR DRYING A CONTINUOUSLY MOVING WEB OF MATERIAL

The present invention relates to dielectric heating apparatus, and, more particularly, to apparatus suitable for the application of dielectric heat to the drying of a moving wet web of paper, pulp or paperboard in a conventional papermaking machine.

Dielectric heating has been applied to the drying of moving webs of paper, pulp or the like for some time and it has been recognized that certain advantages are achieved when dielectric heating is incorporated as one stage in a papermaking machine. One of the biggest advantages inherent in dielectric heating of wet webs of material is the so-called leveling effect whereby higher moisture content areas of the web automatically receive more energy for a given field strength than do low moisture content areas with the result that more uniform drying of the web is achieved than with conventional steam cylinders. Furthermore, if the dielectric heat applicator is introduced at an early stage of the papermaking machine the moisture which was initially at the center of the web is moved outwardly to the surface portions of the web by the dielectric heat applicator so that subsequent steam cylinder dryers may remove more moisture and hence operate more efficiently than if a hard dry surface is presented to them from the earlier steam cylinders in the machine.

One such application of dielectric heating to the paper industry is described in an article by Mark D. Preston entitled "Dielectric Dryers Can Improve Paper Machine Performance" appearing in Paper Trade Journal for Jan. 22, 1968. In this article stray field type electrodes are employed in the application of dielectric heating at an intermediate point in the papermaking machine. While the stray field type of electrode is considerably more effective than the earlier platen type when applied to these webs, the stray field type electrode is quite sensitive to changes in the separation between the web and the dielectric heating electrodes. Furthermore, when the electrode structure is flat, as in the Preston article, and the paper web is stretched as it is moved over the rods, longitudinal wrinkles are produced in the web which result in variations in spacing between the web and the fixed electrode structure. This in turn produces nonuniform drying of the web as it is moved past the electrode structure.

While the above discussed advantages of dielectric heating had been appreciated for some years, the paper industry has been generally reluctant to incorporate dielectric heating into existing papermaking machinery. One of the reasons that dielectric heating has not received more widespread acceptance in the paper industry is that the dielectric heating units which have been employed thus far have been used in conjunction with relatively narrow webs whereas the paper industry has numerous applications where webs as high as 350 to 400 inches are required. When wide webs are to be dried, the above discussed problems of wrinkling are accentuated. Furthermore, the apparatus for moving a wide web must be able to withstand considerably greater physical loads due to the increased weight of the web and to withstand strains up to the breaking strength of the paper which may run upwards of 80 pounds per lineal inch, while at the same time providing an arrangement in which the spacing between web and electrodes is very small and is maintained very accurately during movement of the web past the electrodes.

It is, therefore, an object of the present invention to provide a new and improved dielectric heating apparatus for use in the drying of moving wet webs of material which overcomes one or more of the above-discussed disadvantages of prior art arrangements.

It is another object of the present invention to provide a new and improved dielectric heating arrangement for drying wide webs of paper, pulp, paperboard or the like, wherein the web to electrode spacing is maintained constant across the entire width of the web as the web moves past the electrode array so that uniform heating of the web is assured.

It is still another object of the present invention to provide a new and improved dielectric heating arrangement for drying wide wet webs of material wherein a curved moving surface is provided for supporting the web and moving it past a closely adjacent curved electrode array, this curved surface acting to smooth out longitudinal wrinkles in the web while at the same time maintaining the spacing between the web and the electrode substantially constant across the entire width of the web.

It is a further object of the present invention to provide a new and improved dielectric heating arrangement for drying wide wet webs of material wherein a rotatable drum structure is provided for supporting the web on its periphery and moving the web past a stationary set of electrodes, these electrodes being positioned close to the periphery of the drum over a substantial portion of its circumference so as to provide uniform drying of the web while utilizing a minimum of floor space therefor.

A still further object of the present invention is to provide a new and improved dielectric heating arrangement for drying wide wet webs of material wherein a rotatable drum structure is provided for supporting the web on its periphery and moving it past a stationary set of electrodes positioned close to the periphery of the drum over a substantial portion of the circumference thereof, said drum comprising a series of closely spaced members which extend parallel to the axis of the drum, the outer edges of said members acting as the outer periphery of said drum on which the web is supported as it is moved past said electrodes.

It is another object of the present invention to provide a new and improved dielectric heating arrangement for drying wide wet webs of material wherein a rotatable drum structure is provided for supporting the web on its periphery and moving it past a stationary set of electrodes and facilities are provided for initially feeding the web between the periphery of the drum and said electrodes.

It is still another object of the present invention to provide a new and improved dielectric heating arrangement for drying wide wet webs of material wherein a curved moving surface is provided for supporting the web and moving it past a closely adjacent curved electrode array and facilities are provided for moving the electrode array away from said curved surface to facilitate initial feeding of the web past said electrode array.

Briefly, in accordance with one aspect of the invention, a dielectric heating arrangement for drying wet webs of paper, pulp, paperboard or the like, is provided which includes a rotatable drum structure positioned for movement about a horizontal axis which is perpendicular to the path of movement of the web, this rotatable drum structure acting to support the moving wet web in accurately spaced relationship to a closely adjacent curved electrode array which is positioned around the periphery of the drum and extends for approximately 270° of its circumference. This drum structure is of relatively large diameter so that the moving web is subjected to the drying action of dielectric heat for a substantial period of time while the drum is being rotated through 270° while at the same time providing a structure which occupies relatively small floor space as compared with a linear run of dielectric electrode array having the same drying capacity.

In order to provide a web supporting surface on the periphery of the drum structure which is a nonconductor of electricity and does not absorb heat from the electric field while at the same time providing an arrangement which is sufficiently strong that it will withstand the high mechanical stresses associated with a web of heavy pulp or board and provide the necessary relative movement between the web and the stationary electrode array, while at the same time providing an arrangement wherein the passage of moisture from the back surface of the web into the interior of the drum is permitted to provide efficient drying action; the periphery of the drum comprises a series of radially extending slats which are made of high strength, low loss and high temperature plastic material and are retained within keyhole slots in a series of discs extending along the length of the drum. These plastic slats are spaced relatively close together so that they maintain an accurate spacing of the web with respect to a cylindrical array of fixed stray field type electrodes but these slats are spaced sufficiently far apart to provide a clear path for the vapors evaporated from the rear surface of the web so as to enhance the drying action during travel of the web past the fixed electrode array.

In accordance with a further aspect of the invention, the electrode array is supported on groups of transversely positioned plastic support members, these support members being arranged in ninety degree segments so that each 90° segment of the electrode array can be moved outwardly away from the surface of the drum to provide adequate clearance for initial threading of the web over the drum or removal of a broken web therefrom.

Each electrode array preferably comprises a series of closely spaced hollow electrically conductive pipes through which water at or near the boiling temperature is circulated so as to prevent the recondensation of water which has been evaporated from the web onto cold surfaces of the electrode array.

In accordance with a further aspect of the invention the boiling water which is circulated through the electrode array is derived from one of the steam cylinders at another point in the papermaking machine and is then returned to the main steam boiler which supplies these steam cylinders.

The invention, both as to its organization and method of operation, together with further objects and advantages thereof, will best be understood by reference to the following specification taken in connection with the accompanying drawings in which:

FIG. 12 is a fragmentary side elevational view of a portion of FIG. 3 but shown on a somewhat larger scale;

FIG. 13 is a block diagram illustrating the manner in which the dielectric heating apparatus of the present invention is incorporated in a conventional papermaking machine;

FIG. 14 is a sectional view taken along the lines 14—14 of FIG. 2;

Figure 1:
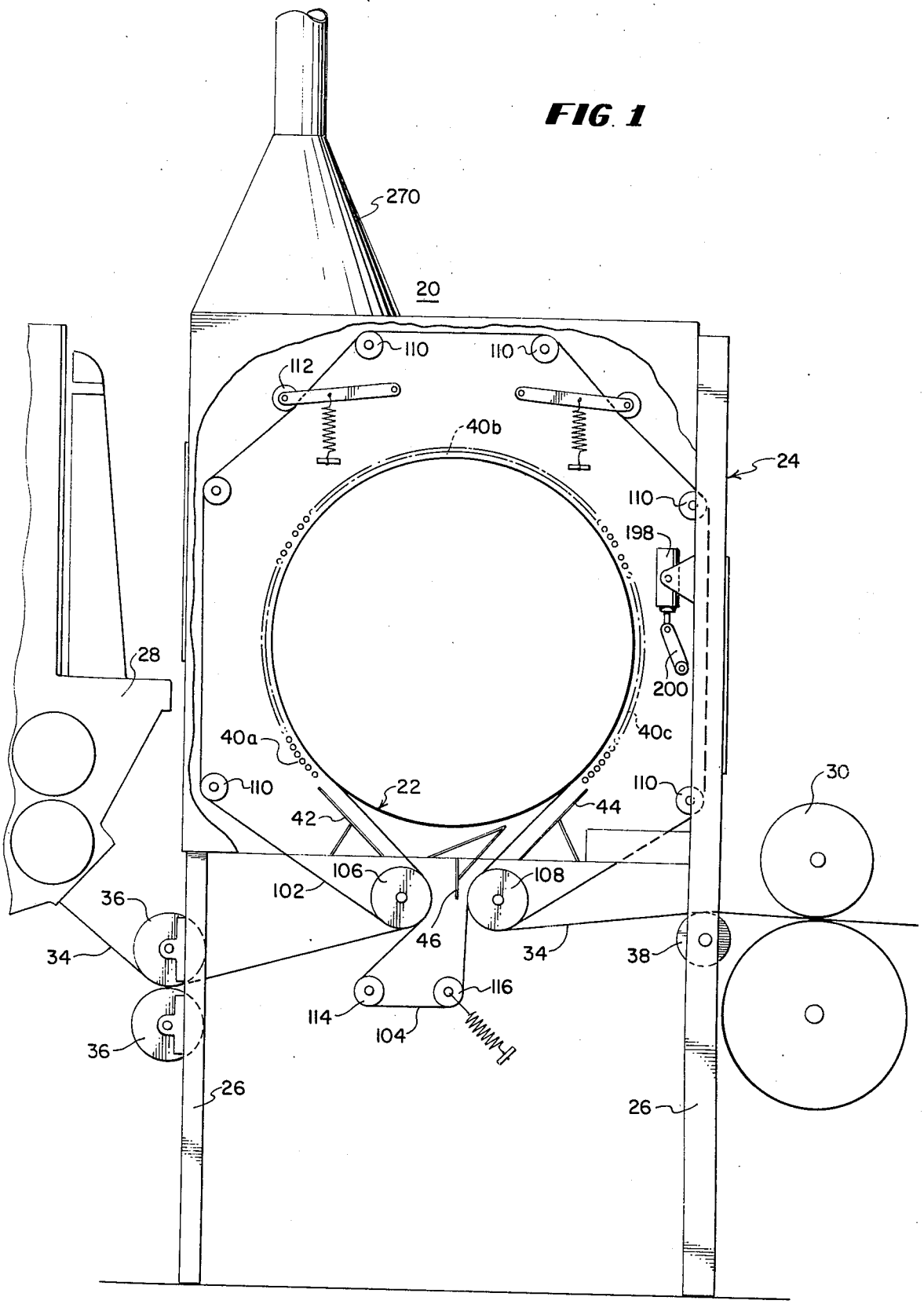
FIG. 1 is a side elevational view of the dielectric heating apparatus of the present invention shown partly broken away and in conjunction with adjacent portions of a conventional papermaking machine.

Referring now to the drawings, the dielectric heating applicator or RF dryer of the present invention is designed to be incorporated into existing papermaking machines in such manner that the efficiency of the overall machine may be substantially increased without requiring complete redesign of the machine or movement of substantial portions of the apparatus thereof. To this end, the RF dryer or dielectric heat applicator apparatus 20 (FIGS. 1 and 13) comprises a rotary drum structure indicated generally at 22 which is of relatively large diameter and is rotatably mounted within a shielded housing indicated generally at 24 which is supported on the posts 26.

In the illustrated embodiment the RF dryer 20 is arranged to be inserted between a conventional steam cylinder dryer 28, which forms one of the initial stages of the papermaking machine, and the press rolls 30 of an unused press which is normally positioned ahead of the final steam cylinder dryer indicated generally at 32. The moving wet web of material 34, which may comprise a web of paper, pulp, paperboard, or any other material capable of conforming to the periphery of the drum structure 22, is usually supplied through the pinch rolls 36 and over a Mount Hope roller 38 to the press rolls 30. However, since the drum structure 22 is positioned transversely of the path of movement of the web 34 and is of relatively large diameter a substantial drying action can be achieved with the applicator 20 of the present invention while occupying a minimum of floor space for the RF dryer equipment.

In the event the wet web 34 is not of sufficient strenght to be moved around the drum structure 22 by itself, it may be supported by a permeable carrier of suitable material, such as felt or the like, which is used as a backing strip.

The RF dryer apparatus 20 includes an electrode array 40 in the form of three groups of electrodes 40A, 40B and 40C which are positioned in closely spaced relationship to the periphery of the drum structure 22 and extend parallel to the longitudinal rotary axis thereof. The arrays 40A, 40B and 40C are thus each of arcuate formation and each occupy approximately 90° along the circumference of the drum 22 so that the moving web 34 is exposed to dielectric heating action over approximately 270° of the circumference of the drum 22 as this drum is rotated.

In order to shield the bottom of the housing 24 in the area of the moving web 34 so that operating personnel are protected, a first member 42 extending along the length of the drum 22 is provided in the area where the web 34 is moved into engagement with the drum 22 and a pair of guide members 44 and 46, also extending along the length of the drum 22, are provided at the exit end of the drum structure where the web 34 leaves the electrode array 40C. The members 44 and 46 also act as guide members to insure that the moving wet web is guided properly as it leaves the drum 22.

Considering now in more detail the structure of the rotary drum 22, it is first pointed out that this drum structure must physically support the moving wet web 34 and move it past the electrode arrays 40*a*, 40*b* and 40*c* while maintaining an accurate spacing with respect to the electrodes of these arrays. When it is realized that the drum 22 must support the entire breaking strength of the paper web 34 plus a safety factor and this breaking strength can be upwards of 80 pounds per lineal inch, it will be apparent that the drum structure 22 must have substantial physical strength, particularly for applications where the moving web 34 is relatively wide. In some instances papermaking machines are arranged to work with webs as wide as 350 to 400 inches. However, the periphery of the drum structure 22 must also be a low loss nonconductor of electricity so that it does not absorb heat from the electrode array 40 and, in order to provide efficient drying action, the supporting surface of the drum 22 should preferably permit the passage of moisture outwardly from the rear surface of the web 34 into interior of the drum 22, as well as from the front surface thereof. In adition the drum structure 22 should either be impervious to electric arc damage, since the periphery thereof is very close to the electrode array 40, or in the alternative the peripheral surface should be readily removable and replaceable in the event a portion of the drum is burned by an electric arc. Furthermore, the drum structure must withstand all of the above discussed stresses while operating in an ambient temperature above the boiling point of the product being evaporated, which is usually water.

Figure 9:
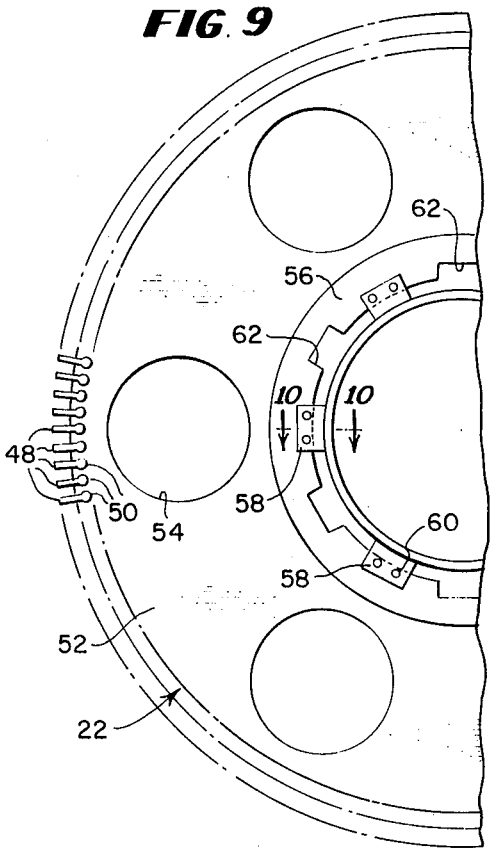
FIG. 9 is a left-side view of the rotary drum structure of FIG. 6.

In order to resolve the above described conflicting requirements, and in accordance with an important aspect of the present invention, the drum structure 22 is arranged so that its periphery is formed by a number of elongated slats 48 (FIG. 9) which are positioned on edge and extend the entire length of the drum 22 parallel to the rotary axis thereof. The slats 48 are provided with portions of enlarged cross section 50 which are retained in corresponding keyhole-shaped openings in a series of transverse discs 52 which are in turn supported on the central shaft 54 of the drum structure 22. The slats 48 are thus retained in the discs 52 and are movable with the shaft 54 while at the same time permitting one or more of these slats to be removed from the drum structure 22 by sliding them out of the keyhole openings of the discs 52 along the axis of the drum 22.

The slats 48 are constructed of plastic material so that they will not absorb appreciable heat from the dielectric heating electrode array positioned adjacent the tips thereof, the slats 48 being preferably made of a thermosetting resin or a high temperature thermoplastic resin so that they will not soften at the elevated temperature at which they operate and become mechanically unstable. In addition, the slats 48 are preferably glass fibre reinforced and are formed by the pulltrusion method so that they have good load carrying ability and can act as rigid beams to support the heavy web 34 and maintain it accurately spaced with respect to the electrode array 40 while operating at the required elevated temperature. For example, the slats 48 may comprise a glass fibre reinforced thermosetting resin such as the polyesters, epoxies, or some of the silicones. Also, the slats 48 may comprise a glass fibre reinforced thermoplastic resin such as the aromatic copolyesters and polyphenylene sulphides. A preferred material for the slats 48 is glass fibre reinforced diallyl phthalate resin fabricated by the pulltrusion method which has low dielectric heating losses and extremely good mechanical properties and dimensional stability, high tensile strength and high modulus of elasticity, so it can act as a rigid beam in supporting the wet web 34 and maintaining it accurately with respect to the electrode array 40.

It will be understood that the moving wet web 34 is stretched tautly over the ends of the slats 48 and will extend in generally straight line segments in the space between these slats. Accordingly, the slats 48 are preferably spaced sufficiently closely together that they support the moving web 34 in an arc which conforms very closely to the arcuate position of the electrode arrays 40*a*, 40*b* and 40*c*. However, the slats 48 are relatively narrow so that they provide a substantial free space behind the web 34 and opening into the interior of the drum 22 so as to permit evaporation from the back side of the web 34 as well as from the front side which is spaced only a fraction of an inch from the electrodes of the arrays 40*a*, 40*b* and 40*c*.

The discs 52 are positioned at intervals along the shaft 54 so that they give adequate support for the slats 48 and so that these slats can withstand the high mechanical stresses encountered with webs of heavy pulp or board. Furthermore, the discs 52 are each provided with a number of large openings 53 to permit the circulation of the moisture evaporated from the wet web and permit these vapors to move out of the housing 24, as will be described in more detail hereinafter.

The discs 52 are of plastic material having substantial strength, preferably a glass fibre reinforced polyester or one of the other materials mentioned for the slats 48, and are strengthened by means of a pair of annular steel supporting flanges 56 which are positioned on either side of the discs 52. The central opening of the discs 52 is machined to fit the outer surface of the shaft 54 so that the slats 48 positioned in the outer edges of these discs will be accurately spaced from the electrode array 40. The discs 52 and flanges 56 are secured to mounting lugs 58, which are welded to the periphery of the shaft 54, by means of the bolts 60. In order to permit removal of the discs 52 and their associated flanges 56, the discs 52 and flanges 56 are all provided with notches 62 (FIG. 9) in the inner edge thereof which may be moved into alignment with the lugs 58 so that the discs 52 and flanges 56 may be slid along the length of the shaft 54 and removed. In the alternative, the central portion of the discs 52 may be made of steel and machined to fit the outer surface of the shaft 54, an annular sheet of plastic material being secured to each steel disc and having keyhole slots in the periphery thereof in which the slats 48 may be mounted as described heretofore.

Preferably the shaft 54 is in the form of a hollow steel pipe of relatively large diameter and thickness so that the drum structure 22 may accommodate relatively wide webs of material, which may be several hundred inches in width, and still provide the required physical strength for supporting and moving the wet web while maintaining it in accurate registration with respect to the fixed electrode arrays. For uniformity of heating, variations in the spacing between the web 34 and the electrode arrays 40*a*, 40*b* and 40*c* must be held to within 0.03125 inch or less under all web tension conditions, drum eccentricities, deflections due to loading, and the like. Web tension may vary from one pound to 40 pounds per inch of web width. Accordingly, the shaft 54 has to maintain the desired spacing under these conditions. Although the breaking strength of the web can exceed 80 pounds per inch, such tension is not anticipated during operation so that the deflection of the shaft 54 under these conditions may increase. However, the shaft 54 still has to be capable of withstanding this breaking strength without permanent deformation.

By way of illustration, and not in any sense a limitation to specific values given, one embodiment of the invention comprises a drum 22 having an overall diameter of 6 feet and having a length of approximately 160 inches. The slats 48 are spaced 1 ½ inches apart on the circumference of the drum 22 with a space between each slat equal to about three times the width of the slat. The shaft 54 is 24 inches in outside diameter and ⅝ inch thick and the discs 52 are positioned two feet apart along the length of the shaft 54.

Figure 6:
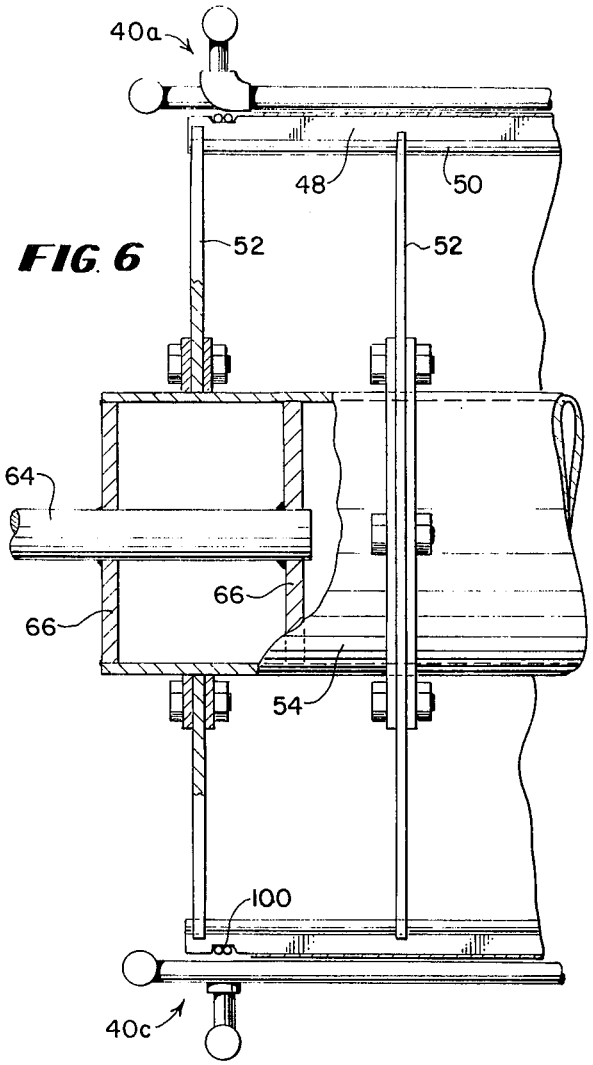
FIG. 6 is sectional view taken along the line 6—6 of FIG. 4.
Figure 11:
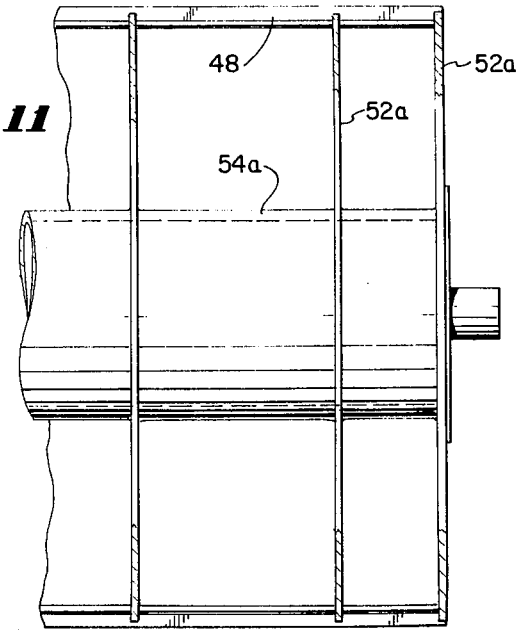
FIG. 11 is a fragmentary side elevational view similar to FIG. 6 but showing an alternative drum construction.
Figure 10:
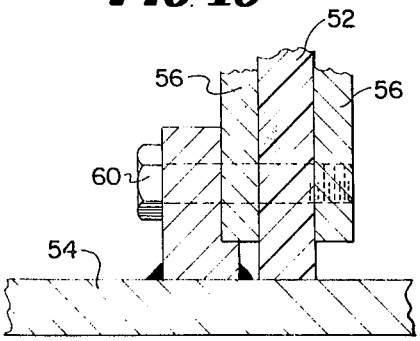
FIG. 10 is a sectional view taken along the line 10—10 of FIG. 9.

If desired, the alternative drum structure shown in FIG. 11 may be employed wherein a hollow plastic pipe 54*a* of substantial thickness is employed as the central shaft instead of the iron pipe 54 shown in FIG. 6. The discs 52*a* are secured to the shaft 54*a* by means of a suitable plastic welding operation and are thereafter rigidly connected to the shaft and cannot be removed therefrom.

Figure 15:
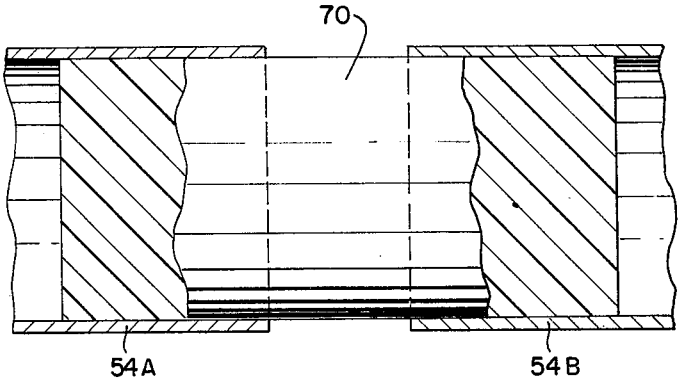
FIG. 15 is a fragmentary side elevational view of the central shaft employed in the drum structure of FIG. 1.

The drum structure 22 is arranged to rotate on stub shafts 64 which are mounted on the ends of the shaft 54. More particularly, a pair of transversely spaced plate 66 are secured in each end of the shaft 54 by any suitable means such as welding and the stub shaft 64 is positioned in central openings in the plates 66 as by welding or the like. However, since the shaft 54 must necessarily extend throughout the entire length of the drum 22, when a wide web of material is to be dried, the length of the shaft 54 can be an appreciable portion of one wave length at the operating frequency of the RF generator which supplies the electrode array 40 with power, as will be described in more detail hereinafter. Accordingly, the steel pipe 54 which acts as the physical support for the drum structure may become resonant and achieve a high voltage because of its coupling to the adjacent electrode arrays 40*a*, 40*b* and 40*c*. To prevent this, the steel pipe 54 is interrupted at several places along its length, preferably not at the middle thereof, by strong supporting inserts of insulating material. Thus, as shown in FIG. 15, the shaft 54 may be broken up into individual sections such as the section 54A and 54B and an insert 70 of insulating material of suitable strength is inserted into the ends of the steel pipe sections 54A and 54B so as to provide a rigid shaft structure to support the discs 52. The gap between the ends of the sections 54A and 54B need be only a few inches to prevent resonance and circulating currents from flowing in the shaft 54 due to the surrounding electrode structure. In this connection it will be understood that any other suitable arrangement for providing electrical discontinuities along the length of the shaft 54 may be provided so long as the overall strength of this shaft is maintained.

Since the stub shafts 64 are also within the electric field established by the electrode arrays 40, it is necessary to mount these shafts in bearings which have no appreciable high frequency current flowing through them. If any appreciable amount of RF current flows through one of the bearings, small pin point arcs may occur and while these arcs do not greatly affect operation of the heating of the dielectric heating system, the small arcs, being very hot, burn the grease in the bearing to an ash and this ash acts as an abrasive grit which very quickly wears the bearing out completely. In order to avoid this situation the stub shafts 64 are mounted in bearings 72 (FIGS. 2 and 14) which are secured to heavy bars 74 the ends of which are supported by means of insulators 76 which are positioned between the bar 74 and an I beam support 78. The I beam 78 is supported from a frame indicated generally at 80 (FIG. 14) by means of the bracing members 82, 84 and 86.

In accordance wth a further feature of the invention, the entire drum structure 22 and the above-described support structures for the bearings at each end thereof are arranged to be removed as a unit from the housing 24 for service and maintenance thereon. To this end, the frame 80 is provided with depending leg portions 88 (FIG. 14) which support axles 90 on which wheels 92 are mounted. The wheels 92 are arranged to roll on I beam track members 94 (FIG. 2) which extend from front to back of the housing 24. Preferably, the wheels 92 normally rest on end support beams 96 which are supported by the posts 26, and the I beam members 94 are removed during normal operation so that they do not interfere with movement of the web 34. However, when it is desired to remove the drum structure 22 from the housing 24, the members 94 are assembled to the end pieces 96 and provide a track on which the wheels 92 may run as the drum structure 22 is removed.

Figure 2:
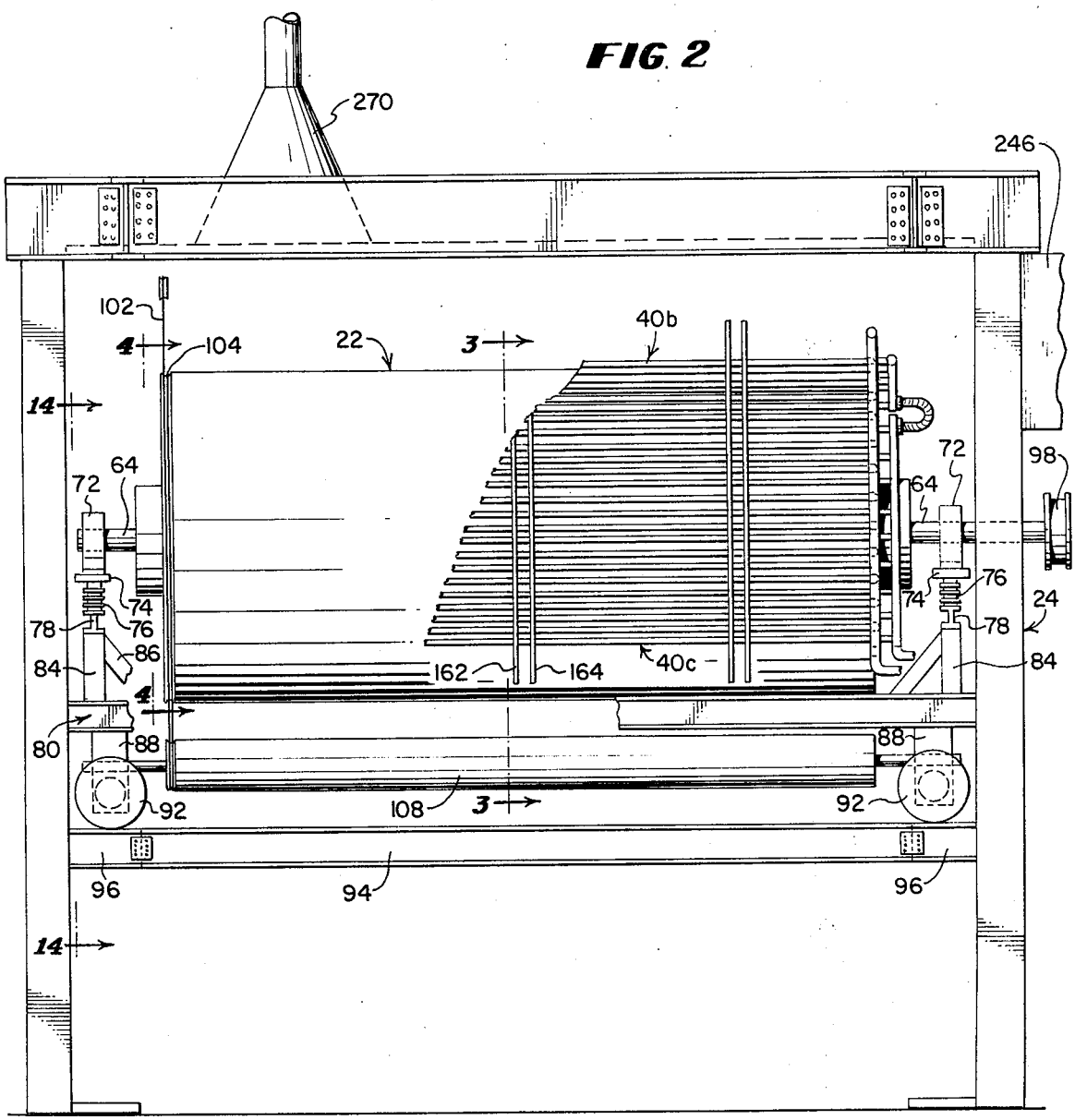
FIG. 2 is a right-side view of the dielectric heating apparatus of FIG. 1.

In order to rotate the drum structure 22 at the speed of the moving web 34, the rear one of the stub shafts 64 extends out of the end of the housing 24, as shown in FIG. 2, and a suitable pulley 98 is secured thereto so that the drum structure 22 may be driven at the proper speed, which may be in the order of 22 rpm in a typical pulp installation. The pulley 98 is in turn driven by a suitable motor which is controlled by the overall control system of the papermaking machine so that the speed of the drum structure 22 conforms at all times to the speed of the moving web 34 regardless of the type of material which is being used.

In order to thread the web 34 over the drum structure 22 at the start of the papermaking operation, a rope carrier arrangement is provided for securely grasping a long "tail" cut on one edge of the web and holding it as the drum structure is slowly rotated to move the web 34 initially around the periphery of the drum. To this end, a groove is formed in the periphery of the drum at one end thereof by providing a notch 100 in each of the slats 48, as best illustrated in FIG. 6. Two ropes 102 and 104 (FIG. 1) are arranged to be positioned within the groove formed by the notches 100 in the slats 48 and each of these ropes is placed under tension so that when the tail of the web material is placed between these two ropes, it will be grasped firmly and pulled along as the ropes move with the drum structure 22. More particularly, the rope 102 extends over one of the turning rolls 106, round the drum 22, over the opposite turning roll 108, and around a series of pulleys 110 located within the housing 24. Tension in the rope 102 is maintained by means of the spring biased roller 112. The rope 104 extends around a fixed pulley 114, and moves alongside the rope 102 in a groove formed in the turning roll 106 at a location corresponding to the groove 100 in the drum structure 22. After it leaves the roll 106, the rope 104 also falls in the groove 100 provided in the slats 48 and after it leave the drum 22 moves alongside the rope 102 in a groove formed in the other turning roll 108. The rope 104 then moves over a spring biased pulley 116 which functions to maintain tension in the rope 104.

Since the ropes 102 and 104 are in close proximity to the electrode arrays 40*a*, 40*b* and 40*c*, it is necessary to use ropes of a material which will not absorb appreciable RF energy and heap up unduly. Preferably, the ropes 102 and 104 are formed of polypropylene or polyester so as to minimize the absorption of heat thereby.

In the illustrated embodiment the turning rolls 106 and 108 are also mounted on the underside of the frame 80 so that they are removed with the drum structure 22 in the manner described heretofore.

Referring now to the details of the dielectric heat applicator of the present invention, whereby moisture is removed from the web 34 as it is moved by the drum structure 22, the electrode arrays 40*a*, 40*b* and 40*c* are of the stray field electrode type wherein all of the electrodes are positioned on the outside of the web as it is carried by the drum structure 22 and an RF voltage is applied to adjacent electrodes. Each of the three electrode arrays occupies a circumference of approximately 90° around the periphery of the drum 22. Thus, considering the array 40*c* (FIG. 5), this array comprises a first series of hollow copper pipes 120 which extend parallel to the axis of the drum 22 and are spaced a very slight distance, in the order of ⅛ to ½ of an inch, from the outer surface of the web 34 around a ninety degree segment of the periphery of the drum 22. The array 40*c* further comprises a second series of hollow copper pipes 122 which are interspersed with the pipes 120 and extend parallel thereto in close proximity to the web 34. The pipes 120 are connected at either end thereof to the arcuately shaped header portions 124, these header portions also being of copper pipe to provide electrical connection between the pipes 120 at the ends thereof. In a similar manner the pipes 122 are connected to arcuately shaped header portions 126 which are also electrically conductive so as to connect the other ends of the pipes 122 together electrically.

It is desirable to operate the electrodes of the array 40*c*, i.e., the pipes 120 and 122, at a temperature such that the evaporated water which is being removed from the wet web 34 does not recondense on the surface of these electrodes. If this occurs, droplets of water may be formed which will drip back onto the web or onto an adjacent electrode. In many cases when this happens an electric arc will follow the droplet of water and the equipment will become unreliable due to arcing caused by the presence of the water. Also, if the moisture condenses on any insulating surfaces which support the electrode this can cause arcing across the surface due to the greatly reduced dielectric strength. Accordingly, water at approximately boiling temperature is supplied to the header portions 124 and 126, so that the pipes 120 and 122 are maintained at about the temperature of boiling water to insure that steam does not condense on these electrodes and cause arcing problems. Furthermore, in accordance with a further aspect of the invention, the recondensed steam which issues from the previous cylinder dryer 28 (FIG. 13) in the papermaking machine and which is normally at 300° F. and 50 psi, is employed as the source of very hot water for maintaining the pipes 120 and 122 at a temperature such that recondensation of moisture on these pipes is avoided. More particularly, the condensate from the cylinder dryer 28 (FIG. 13) is supplied through the pipe 130 to a mixer 132 at which tempering water from the line 134 is added so that the output line 136 of the mixer 132 supplies water at approximately 220° F. to the electrode array 40. This water is supplied through plastic inlet pipes 136 (FIG. 4) to the headers 150 and 152 of the electrode array 40*a*. The headers 138 and 140 of the adjacent array 40*b* are connected to the headers 150 to 152 through flexible metal hoses 154 and 156, respectively, so that hot water is supplied to the forward headers 138 and 140 of the array 40*b* and flows through the pipe electrodes 146 and 148 of this array. In a similar manner the headers 124 and 126 (FIG. 5) of the array 40*c* are interconnected by means of the flexible metal hoses 142 and 144, with the header portions 138 and 140, respectively, of the array 40*b*.

The circulating hot water is taken off at the rear end header portions 124 and 126 of the array 40*c* by means of the plastic outlet pipes 158 so that water is circulated from the front end of the drum structure 22 at the start of the array 40*a* to the rear end of the drum structure 22 at the end of the array 40*c*. The water in the outlet pipes 158 is then returned to the steam boiler 160 of the papermaking machine which normally supplies steam to the cylinder dryer 28. The plastic pipes 136 and 158 are neccessary in order to insulate the electrode array 40 from the rest of the structure. The use of recondensed steam as the circulating medium is particularly advantageous because it contains relatively few impurities and hence also functions to insulate the electrode array 40 from the supporting structure.

In accordance with an important aspect of the invention, the electrode arrays 40*a*, 40*b* and 40*c* are physically supported in such manner that they may be moved away from the periphery of the drum 22 by a distance of six inches or more so as to facilitate initial threading of the web 34 over the drum 22 or removal of broken materials in the event that the web 34 becomes jammed or broken within the machine. Thus, considering the array 40*c* (FIG. 5) the pipe electrodes 120 and 122 which comprise this stray field electrode array are supported along the length thereof by pairs of transversely positioned supporting plates of insulating material which has low dielectric heating losses. More particularly, a first pair of supporting plates 162 and 164 are mounted from the side wall of the housing 24. A second set of supporting plates 166 and 168 also supported from the side wall of the housing 24, is provided intermediate the plates 162, 164 and the headers 124 and 126. A third set of supporting plates 170 and 172, similarly supported, are provided between the plates 162, 164 and the headers at the other end of the pipes 120, 122.

Figure 8:
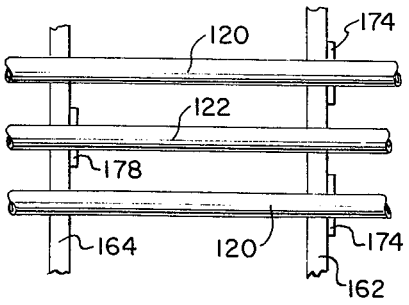
FIG. 8 is a sectional view taken along the lines 8—8 of FIG. 3 and shown on a somewhat larger scale.

Considering the plates 162 and 164 these plates are spaced closely together and provide physical support for the pipes 120 and 122. Thus, as best illustrated in FIG. 12, the pipes 120 are supported on the plate 162 by means of wedge shaped brackets 174 which are secured to the plate 162 by means of the bolts 176. The brackets 174 are shaped at the outer ends thereof so as to conform to the shape of the pipes 120, the pipes 120 Being secured to the brackets 178 in any suitable manner such as by brazing, soldering or the like. The pipes 122 are supported from the adjacent plate 164 by means of the supporting brackets 178 which are secured to the plate 164 by means of the bolts 180. By providing separate supporting plates 162 and 164 for the two sets of pipe electrodes 120 and 122, electrical connection can be made to each group of pipe electrodes while minimizing arcing between adjacent pipes. Thus, considering FIG. 8, the supporting brackets 174 for the pipes 120 are positioned a substantial distance away from the supporting plates 178 for the pipes 122 which are mounted on the plate 164.

Electrical connection is made to each set of pipe electrodes by means of a conductive bar which is mounted on each supporting plate. Thus, considering the supporting plate 162, the conductive bar 180 is secured to the supporting plate 162 by means of the screws 182 and is positioned close to the bottom ends of the brackets 174 so that these brackets may be electrically connected thereto by means of the solder connections 184. In a similar manner the brackets 178 are electrically connected together by a bar similar to the bar 180 which is positioned on the supporting plate 164.

Figure 7:
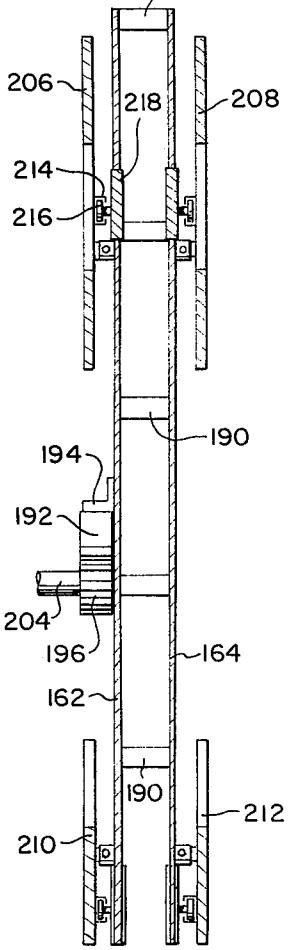
FIG. 7 is a right-side view of the apparatus of FIG. 3.

Considering now the manner in which the supporting plates 162, 164, 166, 168, 170 and 172 are movable as a unit away from the drum 22 so that the electrode array 40*c* may be moved away from the web 34, each pair of supporting plates, such as the plates 162 and 164, is connected together by means of the spacer members 190 (FIG. 7) and a horizontally extending rack 192 is secured to the plate 162 by means of the bracket 194. A pinion gear 196 is rotatably mounted on the frame of the housing 24 in mesh with the rack 192 and is arranged to be actuated by a hydraulic cylinder 198 (FIG. 1) through the linkage 200, 202 and 204. A first pair of triangularly shaped supporting plates 206 and 208 are supported from the housing 24 near the upper ends of the plates 162 and 164 and a similar set of mounting plates 210 and 212 are provided near the bottom end of these plates. Each of the plates 206, 208, 210 and 212 are equipped with a horizontally extending rack, such as the track 214 on the plate 206, which are adapted to receive a pair of guide wheels mounted on supporting brackets on the respective plates 162 and 164. Thus, the track 214 is arranged to receive the pair of guide wheels 216 which are mounted on the bracket 218 which is in turn secured to the plate 162. Similar pairs of guide wheels are provided on the members 162 and 164 and are arranged to cooperate with the tracks 214 on the respective supporting brackets 208, 210 and 212. Accordingly, when the pinion 196 is rotated in the clockwise direction, as viewed in FIG. 3, the entire assembly consisting of the supporting plates 166 to 172, inclusive, and the pipe electrodes 120 and 122 supported thereon, are moved to the right as viewed in FIG. 3 and away from the periphery of the drum 22 so as to provide clearance for threading of the web, and other operations.

Figure 16:
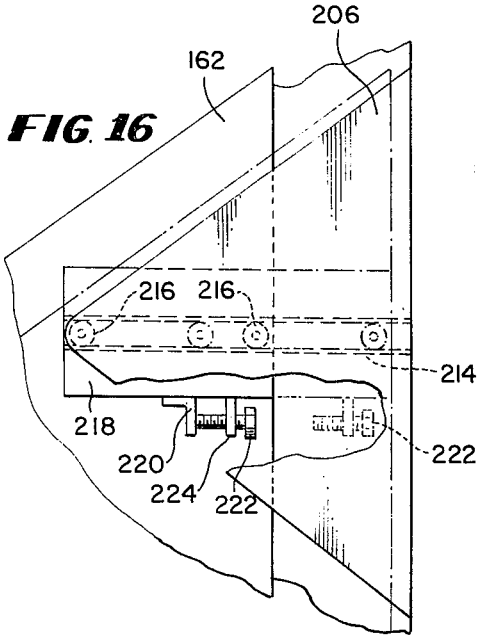
FIG. 16 is a fragementary side elevational view of a portion of FIG. 3 shown on a somewhat larger scale.

In order to provide accurate adjustment of the position of the pipe electrodes 120 and 122 with respect to the outer surface of the web 34 on the drum 22, there is provided an adjustment stop 220 on each of the supporting brackets, such as the bracket 206, which cooperates with an adjustment screw 222 which is mounted on the movable plate 162. More particularly, as best illustrated in FIG. 16, the adjustment screw 222 is threaded through a lug 224 which is carried by the bracket 218 and hence is movable with the member 162. Accordingly, when the supporting plate 162 is moved away from the drum 22 to the position shown in dotted lines in FIG. 16, the adjustment screw 222 moves away from the stop 220. When the supporting plate 162 is again moved toward the drum, the final position of the pipe electrodes 120 and 122 is accurately determined by engagement of the end of the screw 222 with the stop 220. A similar stop mechanism is employed with the supporting plate 164, as well as the supporting plates 166, 168 and 170, 172 so that the pipe electrodes 120, 122 may be accurately adjusted throughout their length to the required close spacing with respect to the web 34.

Each of the other electrode arrays 40*a* and 40*b* is similarly mounted on a series of supporting plates, similar to the supporting plates 166 to 172, inclusive. Thus, the array 40*a* comprising the two series of pipe electrodes 151 and 153, is mounted on a series of supporting plates 230 in the manner described in detail heretofore in connection with the plate 162. The set of plates 230 with the pipes 151 and 153 secured thereto is movable as a unit away from the periphery of the drum 22 under the control of the rack 232 and cooperating pinion 234, as described above in connection with the rack 192 and the pinion 196. The other electrode array 40*b* is likewise supported on a series of transversely extending supporting plates 236 (FIG. 3) these plates being actuated upwardly away from the periphery of the drum 22 by means of the pinion 238 which engages the rack 240 secured to one of the plates 236. A suitable stop mechanism is provided for each of the supporting plates 230 and each of the supporting plates 236 so as to provide accurate positioning of the pipe electrodes of each of the arrays 40*a* and 40*b* with respect to the periphery of the drum 22, as described in detail heretofore in connection with the array 40*c*.

Considering now the manner in which RF power is generated and supplied to the electrode arrays 40*a*, 40*b* and 40*c*, and RF generator 242 is provided to develop the necessary RF power for application to the electrode array 40. Under FCC standards, the generator 242 and the entire housing 24 within which the electrode array 40 is positioned must either be completely shielded so that radiation from these elements is at a very low level or the generator 242 must be operated at one of a few fixed frequencies at which the FCC does not require shielding. When an RF dryer apparatus 20 is employed with relatively narrow webs than it is possible to construct the housing 24 so that it comprises a steel frame-work over which is placed a skin of aluminum which substantially completely encloses the drum structure 22 and associated electrode arrays 40*a*, 40*b* and 40*c*. Under these conditions a so-called vestibule type of shielding can be employed at the entrance to the drying chamber, i.e. in the vicinity of the turning rolls 106 and 108, so that substantially total shielding is provided. However, when the apparatus is to function with relatively wide webs it is impossible to provide vestibule shielding of sufficiently good quality to prevent excessive radiation. This is because the cut off frequency, which is controlled by the width of the vestibule, can be below the operating frequency so that the vestibule does not shield at all but acts as a wave guide to transmit RF energy instead of suppressing it. Accordingly, when relatively wide webs are to be dried, the RF generator 242 is preferably operated at one of the fixed frequencies at which the FCC does not require shielding. However, this means that the harmonic frequencies of the RF generator 242 must be substantially totally suppressed. Since in the illustrated embodiment relatively wide webs of material are accommodated, the RF generator 242 is preferably operated at a fixed frequency authorized by the FCC and is connected by means of a coaxial cable 244 to a group of three termination networks 246 which are positioned at the back of the housing 24. The generator 242 includes a series of trap circuits tuned to the harmonics of the RF operating frequency so that these frequencies are suppressed and the termination networks 126 are provided to match the electrode arrays 40*a*, 40*b* and 40*c* to the generator 242. Preferably each of the networks 246 is connected to one of the electrode arrays through a stripline type of cable which has low inductance and high current carrying capacitry, these cable preferably being of the same length so that symmetrical coupling from these networks to the electrode arrays is provided. Thus, the center conductor and ground conductors of a first stripline type of cable 250 are connected to the array 40*a* as indicated diagrammatically in FIG. 4, the conductors of a second stripline type of cable 252 are connected to the array 40*b*, and the conductors of a third cable 254 are connected to the array 40*c*. More particularly, the center conductor 256 of the cable 254 is indicated schematically in FIG. 5 as being connected to one of the pipes 120 which is approximately in the middle of the electrode array 40*c* and the ground conductor 258 of the cable 254 is connected to the adjacent pipe electrode 122 which is also positioned at the center of the array 40*c* so that RF power is supplied to the mid point of the array 40*c* and between adjacent ones of the electrodes 120 and 122. Preferably, the conductors 256 and 258 are connected to approximately the mid points of the bars 180, as shown schematically in FIG. 3. Each of the bars 180 is in turn connected to alternate pipe electrodes in the array 40*c*, as described in detail heretofore.

Figure 5:
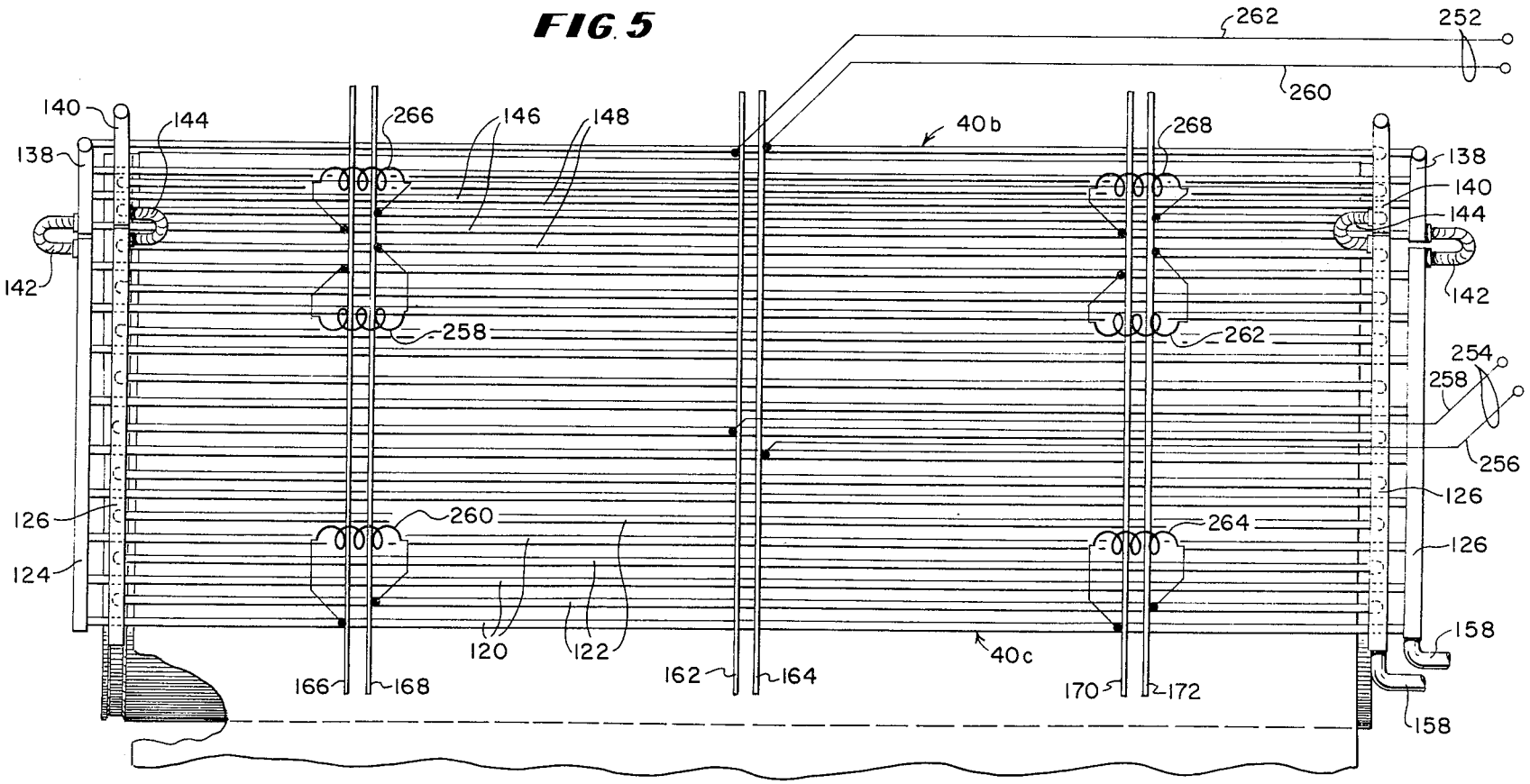
FIG. 5 is a fragmentary side elevational view of the rotary drum and electrode array structure of the apparatus of FIG. 2 shown on a somewhat larger scale.

In this connection it will be understood that all of the electrodes 120 in the array 40*c* are connected together through the bars 180 provided on each of the supporting plates 162, 166 and 170. In a similar manner all of the pipe electrodes 122 are connected together through similar conductive bars on the supporting plates 164, 168 and 172. Also, the ends of the pipe electrode sets 120 and 122 are electrically connected together through the conductive headers 124 and 126, as described heretofore. Accordingly, when the RF power is applied to substantially the mid point of the electrode array, as shown in FIG. 5, a substantially uniform RF voltage is developed between adjacent pipe electrodes 120 and 122 throughout the length of these electrodes. A fixed, stray field type of electrode array is thus provided around the periphery of the drum structure 22 which is highly effective in removing moisture from the web 34. However, as discussed generally heretofore, the effectiveness of moisture removal with this type of electrode array decreases markedly as the spacing between the web and the electrodes increases. The drum structure 22 of the present invention is highly effective in maintaining this spacing across the entire width of a wide web because it smoothes out longitudinal wrinkles in the web and holds it in accurately spaced relation to the electrode arrays as it moves the web past these arrays.

If desired, a series of voltage regulating or tuning stubs may be connected to adjacent electrodes 120, 122 at particular points in the array, as illustrated diagrammatically in FIG. 5, to obtain a uniform voltage distribution, particularly when wide webs of material are to be dried. Thus, a tuning stub 258 may be connected between the top two electrodes 120 and 122 of the array 40*c* at the position of the support plates 166, 168. Similar tuning stubs 260, 262 and 264 may be provided at corresponding points on the array so that uniform voltage distribution throughout the length of the electrodes 120, 122 may be achieved, as will be readily understood by those skilled in the art. In this connection it will be understood that the tuning stubs 258 to 264, inclusive, are preferably connected to the indicated points on the conductive bars, such as the bar 180, which are provided on the supporting plates 166, 168, 170 and 172.

Figure 3:
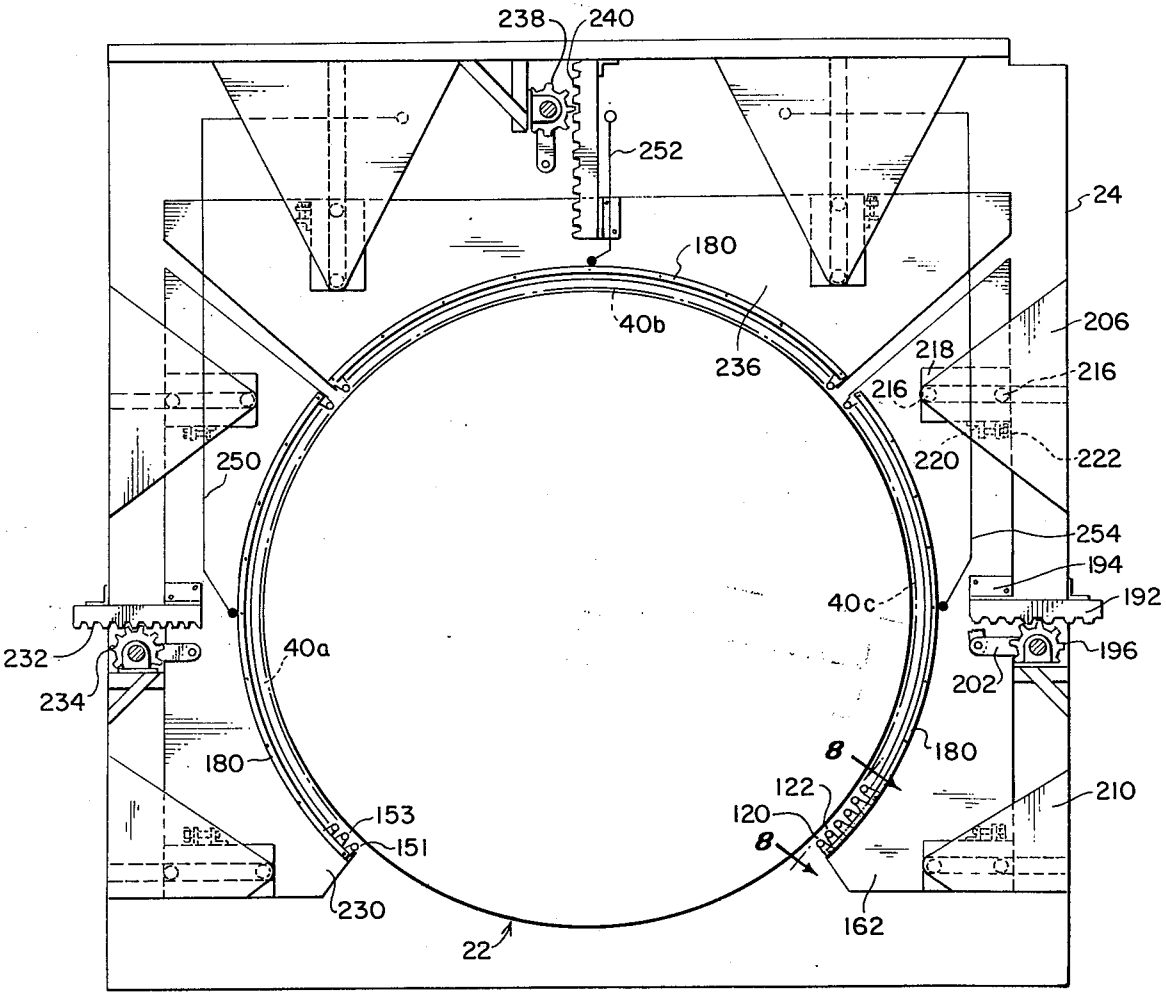
FIG. 3 is a sectional view taken along the lines 3—3 of FIG. 2.
Figure 4:
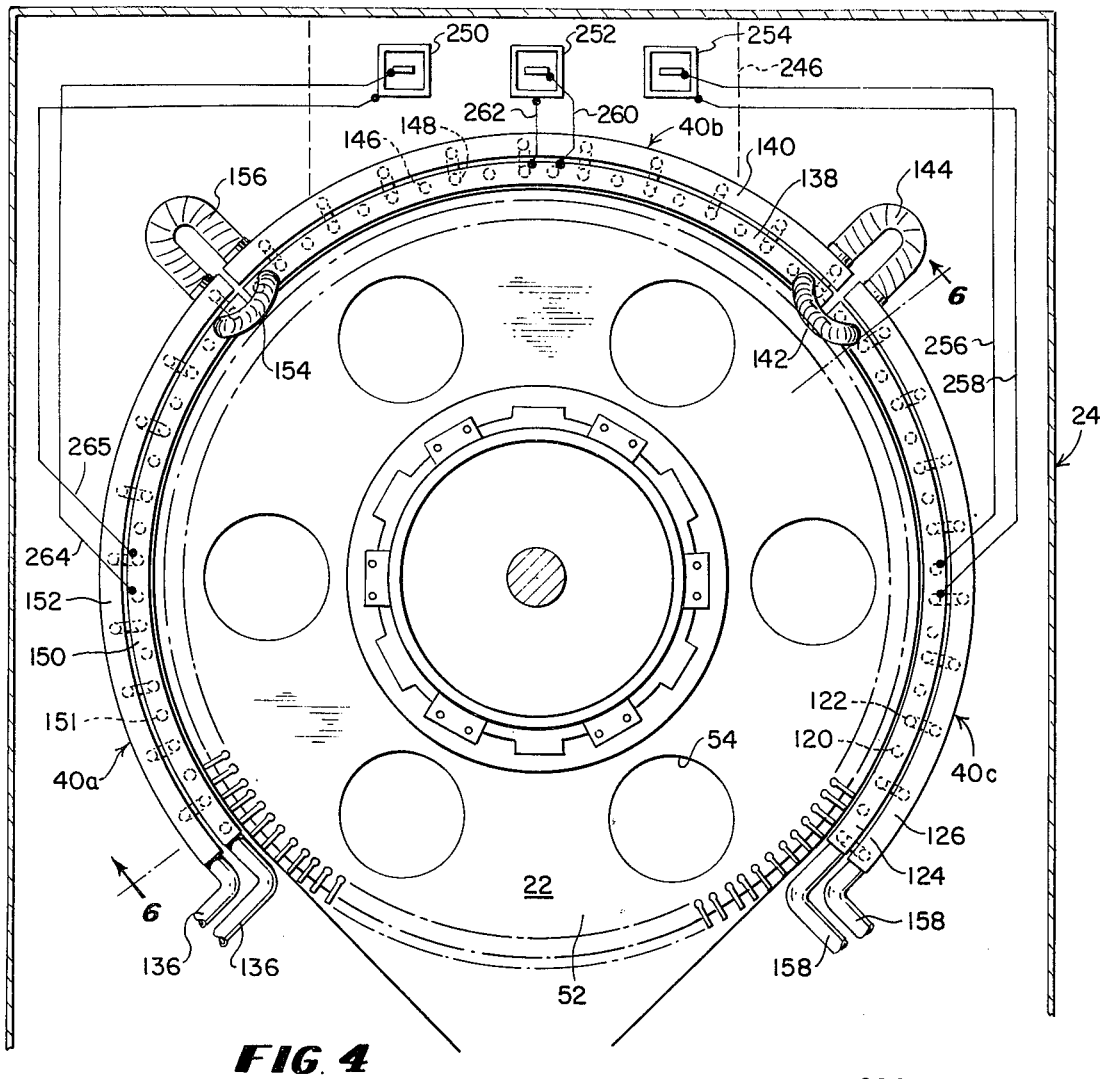
FIG. 4 is a sectional view taken along the line 4—4 of FIG. 2.

In an entirely similar manner, the center conductor 260 and ground conductor 262 of the cable 252 are connected to central points on adjacent ones of the pipe electrodes of the array 40*b*, as shown in FIGS. 3, 4 and 5. Likewise, the conductors 264 and 265 of the cable 250 are connected to central points on the array 40*a*. In addition, the tuning stubs such as the stubs 266 and 268 shown in conjunction with two corners of the array 40*b* may be employed with each of the arrays 40*b* and 40*a* to provide uniform voltage distribution along the length of the pipe electrodes in these arrays.

While an RF generator 242 is preferably operated at a fixed frequency when wide webs are to be dried, as described above, it is nevertheless necessary to have the housing 24 substantially totally enclose the drum structure 22 and electrode arrays 40 so that accidental contact with the electrodes or excessive exposure to the electric field of the electrode system is avoided by operating personnel. In addition it is necessary to collect the vapors driven off of the web 34 as it is dried and exhaust these vapors out of the building. To this end, a suitable exhaust duct 270 is provided in the top of the housing 24 to collect the vapors accumulating in the housing 24 and remove them. Also, as discussed heretofore, the central discs 52 of the drum structure 22 are provided with large openings 53 therein so that vapors which are driven off of the back side of the web 34 and into the interior of the drum 52 may be efficiently moved out of this interior and out of the housing 24.

While there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. In a system for drying a web of flexible material, the combination of, means defining a cylinder whose axis is perpendicular to the length of the web, means for moving the web to be dried in an arcuate path conforming to the periphery of said cylinder over a substantial portion of the circumference thereof, a first series of electrodes positioned close to but out of contact with said web around said substantial portion of the circumference of said cylinder, a second series of electrodes interspersed with said first series of electrodes, said first and second series of electrodes collectively forming a surface which is concentric with said cylinder and outside the periphery thereof, and means for applying and R.F. voltage between said first and second series of electrodes, whereby said web is dried by dielectric heating due to the R.F. field developed between said first and second series of electrodes as said web is moved in said arcuate path.

2. The combination of claim 1, wherein said means for moving the web comprises a drum which is rotatable on said cylinder axis, and means defining a plurality of closely spaced ridges on the surface of said drum which extend parallel to said axis and support the web in said arcuate path.

3. The combination of claim 2, wherein said ridges comprise a series of elongated flat members which are positioned on edge in radial planes extending outwardly from the axis of said cylinder, the web being supported on the outer edges of said members for movement in said arcuate path.

4. The combination of claim 1, wherein said means for moving the web comprises a central shaft rotatable about the axis of said cylinder and extending across the width of the web, a series of transverse discs spaced along the length of said shaft and secured thereto, each of said discs having a series of closely spaced radial slots in the periphery thereof, the slots in each of said discs being aligned in the direction parallel to said axis, and a plurality of support members positioned in said aligned slots and extending beyond the periphery of said discs so that the web is supported on the outer edges of said members and moisture can be removed from the back side of the web in the space between said members.

5. The combination of claim 4, wherein said members are of plastic material capable of withstanding high temperatures without deformation and having relatively low heat developed therein by dielectric heating.

6. The combination of claim 4, wherein said members are of glass fibre reinforced diallyl phthalate resin.

7. The combination of claim 4, wherein the portion of said discs in the vicinity of said members is of plastic material capable of withstanding high temperatures without deformation and having relatively low heat developed therein by dielectric heating.

8. The combination of claim 4, wherein the portion of said discs in the vicinity of said members is of glass fibre reinforced polyester.

9. In a system for drying a web of flexible material wherein the web is partially dried by a steam cylinder dryer and steam employed therein is subsequently recondensed, the combination of, means defining a stray field electrode array comprising a first series of hollow electrodes arranged in an arcuate surface, a second series of hollow electrodes interspersed with said first series of electrodes in said arcuate surface, means for moving the web past said array in closely spaced relation to said first and second series of electrodes, means for applying an R.F. potential between said first and second series of electrodes so that moisture is removed from the web by dielectric heating thereof, and means for circulating said recondensed steam through said hollow electrodes to maintain the temperature thereof sufficiently high to prevent recondensation of the moisture removed from the web onto said electrodes.

10. The combination of claim 9, wherein said first and second series of electrodes are positioned in a surface which is a segment of a cylinder the longitudinal axis of which is perpendicular to the direction of movement of the web.

11. The combination of claim 10, which includes first and second header means respectively interconnecting the hollow electrodes of said series at one edge of the web, third and fourth header means respectively interconnecting the hollow electrodes of said series at the other edge of the web, means for supplying said recondensed steam to said first and second header means so that it moves through said electrodes to the other edge of the web, and means for withdrawing said recondensed steam from said third and fourth header means.

12. The combination of claim 11, wherein said first, second, third and fourth header means are electrically conductive, and said means for supplying and withdrawing recondensed steam is electrically nonconductive.

13. The combination of claim 11, which includes a steam boiler for said cylinder dryer, and means for returning said recondensed steam withdrawn from said third and fourth header means to said steam boiler.

14. In a system for drying a web of flexible material, the combination of, means defining a stray field electrode array comprising a first series of hollow electrodes arranged in an arcuate surface, a second series of hollow electrodes interspersed with said first series of electrodes in said arcuate surface, means for moving the web past said array in closely spaced relation to said first and second series of electrodes, means for applying an R.F. potential between said first and second series of electrodes so that moisture is removed from the web by dielectric heating thereof, and means for circulating hot water through said hollow electrodes to maintain the temperature thereof sufficiently high to prevent recondensation of the moisture removed from the web onto said electrodes.

15. The combination of claim 1, which includes means for moving said first and second series of electrodes away from the axis of said cylinder, thereby to provide clearance for initial threading of the web past said electrodes.

16. The combination of claim 1, which includes means for moving said first and second series of electrodes away from the surface of said drum, thereby to provide clearance between said drum and said electrodes.

17. The combination of claim 3, which includes means defining aligned notches in said outer edges of each of said members adjacent one end of said cylinder, and a pair of tensioned rope carriers positioned side by side in said notches and operative to grip one edge of the web and hold it as the web is initially fed onto said drum.

18. In a system for drying a web of flexible material, the combination of, means defining a cylinder whose axis is perpendicular to the length of the web, a plurality of electrode arrays each positioned around a predetermined segment of the periphery of said cylinder, each of said arrays comprising first and second series of electrodes interspersed with one another and collectively forming a surface which is concentric with the axis of said cylinder and outside the periphery thereof, means for moving the web past said plurality of electrode arrays in closely spaced relation thereto, and means for applying an R.F. voltage between the first and second series of electrodes in each of said arrays, whereby said web is dried by dielectric heating due to the R.F. field developed between said first and second series of electrodes.

19. The combination of claim 18, wherein three electrode arrays are provided each extending approximately 90° around the circumference of said cylinder.

20. The combination of claim 18, which includes means for individually moving said plurality of electrode arrays away from said cylinder to provide clearance for initial threading of said web past said electrodes.

21. The combination of claim 18, wherein each of said electrode arrays includes a plurality of supporting plates positioned transversely of the axis of said cylinder, and means for supporting said electrodes on the inner edges of said supporting plates in closely spaced relation to said web.

22. The combination of claim 21, wherein said supporting plates are arranged in pairs, one plate of each pair supporting said first series of electrodes and the other plate of each pair supporting said second series of electrodes.

23. The combination of claim 21, wherein said plates are of electrically insulating material having low dielectric heating losses, and means electrically interconnecting the electrodes of each of said first and second series in the vicinity of said plates.

24. The combination of claim 23, which includes an R.F. generator, and means connecting the output of said generator to approximately the mid point of each of said electrode arrays, thereby to provide a substantially uniform voltage distribution along said first and second series of electrodes in each of said arrays.

25. The combination of claim 18, wherein said first and second electrodes comprise hollow conductive pipes, and header means for each of said arrays for supplying a heating fluid to said hollow conductive pipes, said header means also connecting together electrically the adjacent ends of each of said first and second series of electrodes.

26. The combination of claim 25, which includes flexible conductive hose means interconnecting the header means of each of said arrays so that said heating medium may flow between said arrays.

27. The combination of claim 4, which includes bearing means for said control shaft at either end thereof, and means for supporting said bearing means from a grounded base member while electrically isolating said bearing means from said base member.

28. The combination of claim 2, which includes an electrically shielded housing surrounding said drum and said electrodes, and a movable support for said drum normally positioned within said housing and movable to a position outside said housing so that said drum may be removed from said housing.

* * * * *

UNITED STATES PATENT AND TRADEMARK OFFICE

CERTIFICATE OF CORRECTION

PATENT NO. : 3,952,421
DATED : April 27, 1976
INVENTOR(S) : Thomas L. Wilson, Charles M. Loring, Peter H. Smith It is certified that error appears in the above-identified patent and that said Letters Patent are hereby corrected as shown below:

Column 1 - line 39, change "effective" to --efficient--.

Column 1 - line 66, change "run upwards of 80" to --run as high as 80--.

Column 5 - line 33, change "upwards of" to --as high as--.

Column 11 - line 18, change "Being" to --being--.

Column 13 - line 35, change "capacitry" to --capacity--.

Signed and Sealed this

Twelfth Day of April 1977

[SEAL]

*Attest:*

RUTH C. MASON
*Attesting Officer*

C. MARSHALL DANN
*Commissioner of Patents and Trademarks*